US010968603B2

(12) United States Patent
Stenlund

(10) Patent No.: US 10,968,603 B2
(45) Date of Patent: Apr. 6, 2021

(54) ELECTRO HYDRAULIC DRIVE AND CONTROL SYSTEM

(71) Applicant: FLUTRON AB, Saltsjöbaden (SE)

(72) Inventor: Stig Stenlund, Saltsjöbaden (SE)

(73) Assignee: FLUTRON AB, Saltsjöbaden (SE)

( * ) Notice: Subject to any disclaimer, the term of this patent is extended or adjusted under 35 U.S.C. 154(b) by 19 days.

(21) Appl. No.: 16/302,318

(22) PCT Filed: May 17, 2017

(86) PCT No.: PCT/SE2017/000027

§ 371 (c)(1),
(2) Date: Nov. 16, 2018

(87) PCT Pub. No.: WO2017/200450

PCT Pub. Date: Nov. 23, 2017

(65) Prior Publication Data

US 2019/0203444 A1 Jul. 4, 2019

(30) Foreign Application Priority Data

May 19, 2016 (SE) ..... 1600171-1

(51) Int. Cl.
*E02F 9/22* (2006.01)
*F15B 21/14* (2006.01)
(Continued)

(52) U.S. Cl.
CPC ..... *E02F 9/2203* (2013.01); *E02F 9/2217* (2013.01); *E02F 9/2228* (2013.01); *E02F 9/2235* (2013.01); *E02F 9/2253* (2013.01); *E02F 9/2292* (2013.01); *E02F 9/2296* (2013.01); *F15B 11/046* (2013.01); *F15B 11/0426* (2013.01); *F15B 11/17* (2013.01); *F15B 15/202* (2013.01); *F15B 21/14* (2013.01); *E02F 9/2267* (2013.01); *E02F 9/2271* (2013.01);
(Continued)

(58) Field of Classification Search
CPC ..... E02F 9/2217; F15B 11/024; F15B 2011/0243; F15B 2011/0246; F15B 21/14; F15B 2211/3133
See application file for complete search history.

(56) References Cited

U.S. PATENT DOCUMENTS 5,378,301 A 1/1995 Boreali et al.
5,428,958 A 7/1995 Stenlund
(Continued)

FOREIGN PATENT DOCUMENTS

DE 19512429 A1 10/1996

*Primary Examiner* — Abiy Teka
*Assistant Examiner* — Matthew Wiblin
(74) *Attorney, Agent, or Firm* — David Guerra

(57) ABSTRACT

A operator supporting electrohydraulic drive and control system based on, position sensors (8) (9), a electronic control unite ECU (2), a recovery, storing and re-use system for energy, and with actuator (3) (4) and the drive control valve (6) (7) bolted together in one (3+6) (4+7) unite and with the valve (6) (7) independently of the ECU (2) is controlling effective use of pump capacity and recovery of energy and with control of speed for low speeds, or prevented speed by valves (6) (7) or pump (10) (10*a*) (11) (11*a*) displacement and for higher speed with control of deplacement of pumps and motors and with valves (6) (7) at the same time controlled to be fully open.

15 Claims, 6 Drawing Sheets

(51) Int. Cl.

| | |
|---|---|
| ***F15B 15/20*** | (2006.01) |
| ***F15B 11/042*** | (2006.01) |
| ***F15B 11/046*** | (2006.01) |
| ***F15B 11/17*** | (2006.01) |
| *E02F 9/26* | (2006.01) |

(52) U.S. Cl.

CPC ..... *E02F 9/26* (2013.01); *F15B 2211/20546* (2013.01); *F15B 2211/20576* (2013.01); *F15B 2211/2656* (2013.01); *F15B 2211/30565* (2013.01); *F15B 2211/31594* (2013.01); *F15B 2211/6306* (2013.01); *F15B 2211/6309* (2013.01); *F15B 2211/6333* (2013.01); *F15B 2211/6336* (2013.01); *F15B 2211/6346* (2013.01); *F15B 2211/6652* (2013.01); *F15B 2211/6654* (2013.01); *F15B 2211/7053* (2013.01); *F15B 2211/7058* (2013.01); *F15B 2211/7135* (2013.01); *F15B 2211/75* (2013.01); *F15B 2211/755* (2013.01); *F15B 2211/7656* (2013.01); *F15B 2211/78* (2013.01); *F15B 2211/88* (2013.01)

(56) References Cited

U.S. PATENT DOCUMENTS

| | | | | |
|---|---|---|---|---|
| 5,794,437 | A * | 8/1998 | Lisniansky | F04B 49/08 60/414 |
| 5,794,438 | A * | 8/1998 | Lisniansky | F04B 49/08 60/327 |
| 5,794,439 | A * | 8/1998 | Lisniansky | F03C 1/003 60/414 |
| 5,794,440 | A * | 8/1998 | Lisniansky | F04B 49/08 60/414 |
| 5,794,441 | A * | 8/1998 | Lisniansky | F04B 49/08 60/414 |
| 6,460,332 | B1 * | 10/2002 | Maruta | E02F 9/2075 60/414 |
| 2011/0270498 | A1 * | 11/2011 | Kawasaki | E02F 9/2075 701/50 |
| 2012/0067432 | A1 | 3/2012 | Vigholm et al. | |
| 2012/0151904 | A1 * | 6/2012 | Shang | E02F 9/2217 60/327 |
| 2012/0312006 | A1 * | 12/2012 | Kawasaki | E02F 9/2235 60/435 |
| 2014/0069091 | A1 | 3/2014 | Franzoni et al. | |
| 2015/0107236 | A1 | 4/2015 | Udagawa et al. | |
| 2016/0237648 | A1 * | 8/2016 | Kawasaki | E02F 9/2075 |
| 2016/0281745 | A1 * | 9/2016 | Shang | F15B 21/14 |

* cited by examiner

ELECTRO HYDRAULIC DRIVE AND CONTROL SYSTEM

TECHNICAL FIELD OF THE INVENTION

The invention relates to the field of hydraulic systems. The primary area of use for the invention is mobile machines as for example, excavators, wheel loaders, cranes and other machines of the same kind. As position sensors are used, is the field of use also favorable within industrial areas. In particular the invention relate: to a hydraulic drive and control system that at the same time in one harmonious system has high productivity, safety and easy machine control for the operator, combined with very efficient use of energy and pump capacity.

The economy side of the invention compared with traditional technique year 2015 is that high productivity for the machine is combined with low costs for the new system due to many eliminated, downsized and simplified functions, that is balancing the higher cost for sensors and the energy recovering and storing system. The cost, when using the machine with the invention, is lower due to less fuel consumption, low maintenance cost, excellent filtration and long system lifetime.

Technical Background

Hydraulic system comprising hydraulic actuators such as hydraulic so called cylinder arrangements with linear movement and hydraulic motors with rotating movements being driven from a common source of pressurized hydraulic fluid such as a pump driven by internal combustion engines are known in the art.

Traditionally such systems are controlled by means of variable restrictions and energy loss due to pressure drop that can't be recovered. Very little has been done to improve the energy efficiency and also to improve the effective use of the pump capacity to only be delivering energy to the actuator and not for example to use pump capacity to control movement when energy can be recovered. To increase the energy efficiency systems incorporating energy recovery systems for recovering and re-using energy of returning fluid from the actuators have been presented. One such system is described in U.S. Pat. No. 6,378,301, which comprises a primary hydraulic pump which supplies pressured hydraulic fluid to two actuators via direction switching valves.

Returning fluid from the actuators is directed to a recovery system having two mechanically coupled together variable displacement pump motors, a pressure accumulator and valves for controlling the flows there between. Although this system is an improvement for energy use over traditional hydraulic drive and control systems efficiency without any energy recovery system, is that invention very limited both, in possibility to control a machine and the total result of the efficiency of the energy recovering system. Only one actuators returning energy can be recovered at a time, and during that time can energy not be re-used. Energy recovery efficiency is the result of two components for recovery and two for re-use of energy where at least two pumps or motors is working with reduced displacement due to control activity. As energy is wasted two times for recovery and for re-use is the total efficiency for the total recovery system very low, and close to 50% with pump and motors that is on the market 2015.

SUMMARY OF THE INVENTION

It is an object of the present invention to provide a hydraulic drive and control system that at the same time in one harmonious system is improving many different and important functions with the ambition to maximize. Typical for many of the important functions is that they are of importance for each other. Typical for mobile hydraulic drive and control system is also that the driven machine has very low average consumption of energy units per time units and very high maximum value often during short time. Typical is also that machines own moving parts that the system is driving together with the load is heavy and often has a weight of about 20% of the maximum load weight. Typical is also for some machine types that they often not is strong enough to move at all or as fast as controlled to do. Typical for all types of machines, controlled of an operator=a person is that a good control system that is easy, safe and not tiring gives the whole machine a higher productivity than what can be reached with a poor control system. A good control system has also shorter learning time and small difference in productivity between talented and less talented operators. The limited ability that the operator normally has to control the machine is in the present invention taken, care of by giving the operator=the man a situation where the operator can focus on what to do and the rest of the drive and control system automatically is responsible for controlling how that is performed so that at the same time productivity, safety, and efficient use of energy and pump capacity is fulfilled in best possibly way.

To be able to automize part of the control is it absolutely necessary to have information of position. The control system has an electric control unit, ECU, that is controlling actuators, valves, pumps, the energy recovering and storing system and the pump drive motor based basically on information of positions and by the computer in the ECU calculated speed and acceleration for varies parts of the machine. Position sensors can be limited to important, hard working actuators that are decisive for machine productivity. The computers part of the ECU gets its important information from in first hand the operator, and calculated speed from the ECU. Other sensors like pressure sensors, pump and motors displacement sensors, is used to reduce the operators control desire down to outgoing control signals from the ECU that is possibly to achieve and suitable for the machine that at the same time is safe, productive and energy efficient. The computer in the ECU system is responsible for out-going control signals to the hydraulic drive system that gives the operator a confident filing that the control is safe. There are specially 3 to 4 difficult control difficulties that are necessary to atomize to support the operator and make control safe and the operator confident. One very problematic and important thing for a hydraulic drive system is that, if the sum of all controlled flows to actuators is bigger than maximum pump flow capacity, will the actuators that have the highest pressure need, be the first one to get less flow than what the operator wants. The control is in that case not working and dangerous situations can be the result. A safe control system must have automatized functions that alternatively are making the total pump capacity higher or the same as the desired total pump flow to actuators or alternatively have functions that are reducing the total controlled flow to actuators so that the total flow is the same or smaller then instant total pump capacity. In this innovation is as a first step when maximum deplacement on the controlled main pump is close to happen, to control by ECU the energy recovering and storing system to increase assisting energy recovering re-use pump system flow and also the motor drive for the controlling main pump to increase rotation speed. Another second important function to automize to improve operator confidence is to control actuator speed and braking function to avoid high speed in end positions in the actuator or other mechanical parts of the machine. Another third important function to automotize is to control speed and force so the risk for the hole machine to overturn can be avoided. The problem is difficult to handle as braking gives forces that are increasing the risk for overturning unless braking start long before the critical point. Another fourth important function when the controlled actuator speed is lower than controlled to be is to make sure that flow from the pump not is flowing over safety pressure valve and give an energy loss. If the ECU can examine incoming signals and changes them in a way that makes the operator confident is that important necessary and good but not enough.

The control signal of what to do must go to a hydraulic drive system that can be energy efficient, be protecting pump capacity, be safe, dependable and give the whole machine high productivity. Control signals from the ECU that make it safer and easier to control for the operator is used in the invention and is important although the technice is known sins long time. The final outgoing signals from the ECU that is controlling the so called drive control valve, pumps and recovery motors are part of the invention in one very important way and is unique for this invention. The object to go to the maximum with everything good at the same time in the invention is based on a mixture of old known technical principle often not used, and also on necessary new technical principles, to make it possibly for the new invention to combine old and new techniques to a new system that can go all the way to the object. To use position sensors and an ECU that can calculate speed, acceleration and other used facts that can support the operator is not new but position information is always necessary for automatization. The new drive system can control and allow movements that is possible and suitably for the machine and all its working drive parts. The ability to change control signals from the ECU to the drive system is not part of the invention, but with position sensors and with the new system possibly to do for the ECU. The structure of the inventions drive system or how different parts is situated in the system and how they are working together is not totally new but seldom used. New is the structure with actuator and one valve; named the drive control valve, strongly bolted together to one drive unite that not needs other valves in the drive system but has one common high pressure pump conduit for flow from the pump system, and one common low pressure return conduit for flow to the fluid tank, and also one individual high pressure energy recovery conduit going from the drive control valve to the actuators own individual hydraulic rotating energy recovering motor.

Historically was from start today's dominating system structure, used and is still used and is one historic survivor from the time when use of hydraulic system started and when the operator=one man for hand was controlling the position of the spool and where all valves was close to the operator and the valves also for the main part of the system was concentrated to one valve unit located in the Centrum of the machine and with two high pressure conduit each was, going all the way to the actuators. The valve unites was also connected to the pump with one relatively short high pressure conduit and also with one relatively short low pressure conduit to the fluid tank. The next two development steeps with the same old system structure was first, hydraulic remote control of the spool positions and second today's electrohydraulic remote control of the valve and its spools.

With time become it clear that the traditionally system, was not in itself safe as a brake and a leak in the conduit to the actuator were allowing the load and parts of the machine to suddenly fall down. The result was that many actuators must by law have extra valve functions strongly bolted to the actuators. Other extra valve function was also located on the actuator to improve the function. With the use of electrohydraulic is the use of central placed multivalve units not a good system structure, and that is even clearer when it is an object to be extremely energy efficient and use pump capacity efficient. It seems to be hard or impossible to use the old structure as in a traditional system that has present inventions objective. The important new thing in this invention, the system structure, the drive control valve then, outgoing control signals from ECU controlling valves and rotating pumps and motors is based on known techniques for used, sensors, computers and hydraulic standard component to be a new system that at the same time is productive, safe and effective on pump capacity and energy use and energy recovery. Besides that is the system structure giving, low costs for the conduits, low cost for maintence, filtration, and to add before or after first time of delivery a new customer ordered job or specific not standard components. To the most unknown thing that the structure can offer is a dramatic increase of filtration performance, air removal and search for mail function and easy start up work, after maintenance.

The drive control valve consist in one unit of a number of different valves and other functions and is more like a sub system, and is not only controlling the direction of machine movement but also low and zero speeds and different high and low hydraulic pressures in the drive system. The drive control valve is working when energy is delivered from the pump system and when energy is received and possible to recover. When the ECU is controlling position, speed, acceleration, or pressure is that based on information from position and pressure sensors, and the operators by the ECU allowed but sometimes reduced speed.

The drive control valve is totally independently of the ECU controlling that pump energy and capacity as well as recovery of energy is efficient performed and based only on information of pressures in the actuators A and B side. Flow from the pump system to A or B is only possible if the flow is going to a pressure that is over a limited pressure level. If the valve function is blocking flow from the pump system is flow instead coming from the low pressure return conduit through one of two check valves and going to the actuators side A or B.

Flow going through the return valve function on the drive control valve can only go to the common low pressure return conduit if the pressure A or B is under a pressure limit. If pressure in the flow is over that pressure limit is the recovery valve closed and the flow forced to go to the actuators individual high pressure energy recovery conduit to an individual hydraulic rotating energy recovering motor that is delivering energy to a common energy recovering and storing system.

The return valve function from A or B is controlled by outgoing signals from the ECU. In series with the return valve function is one valve, the recovery valve controlling flow to or blockings flow to the common low pressure return conduit. If the flow from one side A or B has a pressure over a pressure limit will the recovery valve, that is normally open, close and the only possible flow-way is through the drive control valves individual high pressure recovery conduit to the individual hydraulic rotating energy recovering motor. If the pressure tries to be higher than the actuators max pressure will also the actuator high pressure limiting valve open up.

The drive control valve is compared with traditionally technic new and control of speed is only based on position information from position sensors to the ECU. In the new invention are 3 different control activity working together to maximize controllability and efficient use of pump capacity and efficient use of energy. The drive control valve and the actuator is screwed together to a unit, and the ECU by its outgoing control signals is trying to control direction and speed with one control signal each for the two independent valve functions and try to control flow to or from the actuator. The drive control valve can however independent of the ECU block flow from common high pressure pump conduit and replace that flow with flow coming via a check valve from the common low pressure return conduit and the drive control valve can also independent of the ECU close the recovery valve and direct the return flow from the actuator to the individual high pressure energy recovery conduit of the drive control valve.

The drive control valve is controlling, or depends of:

That the drive control valve is at the same time and all time controlling, that pumps capacity and pump energy and capacity is used in an efficient way.

That energy loss by controlling speed not is using pressure drop as a control method if that is resulting in troublesome energy loss.

That energy that is going to the energy recovering and storing system can be recovered and is recovered in an energy recovering and storing system that can store energy and also re-use energy with a capacity level like the capacity of the drive systems main pump. Both pumps in the pump system must have variable displacement, displacement sensors and be controlled by the ECU.

That holding loads at zero speed with closed valves is possible with very low leakage or no leakage and with no need for extra valves to be able to hold loads.

That pressure in the actuator will be limited to a maximized pressure, by actuator high pressure limiting valve, and minimized by check valves, down to pressures close to the pressure in the return conduit or at least close to atmospheric pressure.

That the drive control valve must be screwed direct together to the actuators without anything between that can leak or brake and as a result of that has the valve very low volume of pressure medium in the drive valve-actuator unit. That will improve filtration, cooling, gas free medium and easier to maintain and at the end gives longer life of the hydraulic drive system.

That all actuators and drive control valves units is coupled to and have one common conduits from the pump system and one to the return to tank side with a total conduit cost that is low and that adding new functions and actuators is easy to do and can be done at low cost.

That the drives, valves, pumps and motors can be electrohydraulic controlled from the ECU and have hydraulic control energy coming primarily from the common high pressure pump conduit and also is using the common low pressure return conduit as the low pressure return side.

Summery; Control of Direction, Speed and Efficient Use of Pump Capacity and Energy Control of the drive systems actuator movement is in this invention divided in two responsibility parts.

The drive control valves own part is total responsibility for efficient use of pump energy and capability by not letting pump flow go to the actuators low pressure side and for directing flow under pressure from the actuator to a energy recovering and storing system. Necessary flow to the low pressure side flows from the common low pressure return conduit over a check valve.

The electronic control unit (ECU) cannot change efficient use of pump capacity and energy but is responsible for control of, direction of actuator movement, actuator speed, displacement for main pump and individual hydraulic rotating energy recovering motor, the energy recovering and storing system including the assisting energy recovering re-use pump and that pumps re-use of energy and the speed of rotation for the motor that is driving the main pump.

ECU is calculating real actuator speed with information of position and position change with time. The operator control unit or, one outside control system is controlling the drive control system and its actuators speed. The ECU are comparing real speed with operator desired speed, and is controlling the drive system actuator with control signals of type, directions and increase or decrease speed. The control signal has no information of the speed itself but only if the speed must increase or decrease.

The allowed desired actuator speed is in this invention named the core actuators speed. The ECU is for all actuator speed controlling the main pump and the individual hydraulic rotating energy recovering motors with a control signal based on core actuator speed and with a control signal of type increase or decrease actuator speed. The control of the drive control valves speed for flow to or from the actuator is based on a higher and even higher actuator speed. The two valves in the drive control valve will open up to the full, and the pressure drop will be low.

The control of speed for the actuator that needs the highest pump pressure is in this invention easy to get by controlling the main pump displacement so that all actuators driven by the pump has actuator speed close to the core actuator speed, all other actuators that needs lower pump pressure has the same high inlet pressure as the actuator that needs the highest pressure acting on the inlet side of the actuators and is balanced on the outlet side with a opposite pressure and a outlet flow of energy that can be recovered. Actuators that are driven from outside and not by the pump have also a flow of pressurized fluid that is recovered the same way with control by ECU of the displacement for the individual hydraulic rotating energy recovering motors.

The speed of the actuator that needs the highest pump pressure is controlled by controlling the displacement of the main pump and all other actuators speed over the low speed limit are controlled by controlling the displacement of the recovery motors.

At zero speed and low speed under speed limits of about 15% to 30% of the maximum speed for the actuator can zero leaks not be possible with rotating pumps and motors and there is not economical to recovery, the energy loss, that is small.

ECU is by controlling the individual hydraulic rotating energy recovering motors displacement to go to maximum displacement stopping recovery of energy under the low actuator speed limit and thereby controlling speed with valves only.

ECU is controlling the drive control valves two valves to and from the actuator to control direction, speed and very low or zero leak of fluid to give the actuator ability to hold the actuator almost at zero speed. The speed for actuator with the highest pressure need is under the low speed limit, ECU controlled to core speed.

Actuators with lower pressure needs is by ECU under the low speed limit controlled by the outlet valve in the drive control valve to core speed plus a small speed adjustment, actuators driven from outside and not by main pump is by the outlet valve in the drive control valve controlled by the ECU to core speed plus a small but lower adjustment then used for the inlet valve.

When the actuator not is strong enough to move at all or not move with allowed desired core speed is the actuator always the actuator that need the highest pressure, and a signal of type increase is trying to increase the main pumps displacement and flow and the pressure in the common high pressure pump conduit. In this invention has the common high pressure pump conduit a high pressure limiting safety valve set to save the system from dangerous stress and also a pressure sensor that is informing ECU if the pressure in the high pressure pump conduit is under but close to the opening pressure for the high pressure limiting safety pressure valve. To prevent energy losses and pump capacity losses will ECU control the main pumps displacement to be going down until no flow will go over the pressure safety valve and the highest pressure in the common high pressure pump conduit to be under the high pressure sensors pressure limit. The control will automatically give max pressure, highest possibly actuator speed, and no energy loss. Here is a catastrophic energy loss situation for the operator, solved automatically by the control of ECU.

The pressure in the actuators and the drives control valves own individual high pressure energy recovery conduit to the individual hydraulic energy recovering motor is measured and informing the ECU that the actuator in the flow of fluid from the actuator has a pressure that is higher than in the conduit going direct to the common low pressure conduit to tank. Below and over the low speed limit for flow from the actuator has all actuators but the actuator needing the highest drive pressure in the flow of fluid from the actuator a higher pressure. The ECU is by that information always informed of what actuator using pump flow that need the highest drive pressure. When actuator speed is over the low speed limit is pressure in the individual high pressure energy recovery conduit much higher than in the common low pressure return conduit and below the limit is the individual hydraulic rotating energy recovering motor with max displacement driven at low speed and needing a relatively low but much higher pressure drop than flow going direct to the common low pressure return conduit.

Position sensors are used in the present invention to measure the positions of actuators or other parts of the machine. To be able to solve problems better for the operator and sometime compensate for hydraulics week performance is it in many situations of value to be able, by position sensors for surroundings to measure positions between, the machine or its parts to something in the surrounding. One example can be to measure the distant between the forks, in a Fork Lift Truck to something of interest in the surrounding. Another example is to measure, by a sensor, the distance from the machine to the ground it stands on to compensate for the hydraulic weakness of leak or on cylinder movement coming from temperature changes in the fluid, and small movements. As the system has its position sensor and ECU, is it relatively easy and to low costs possible to let the drive and control system to automatic handle other things than controlling the machines own moving part within the machine to also be able to controlling the positions for the machine.

BRIEF DESCRIPTION OF THE DRAWINGS

These and other aspects of the present invention will now be described in more detail, with reference to the appended drawing showing a currently preferred simplified embodiment of the invention, wherein

FIG. 1. Is showing an simplified embodiment of the invention.

DETAILED DESCRIPTION

In the following description, an embodiment of the present invention is described with referents to a hydraulic drive and control system having an energy recovery system comprising a flywheel with a variable displacement pump, here named assisting recovering re-use the recovery pump, and two individual hydraulic rotating energy recovering motor connected there to.

Figure 1:
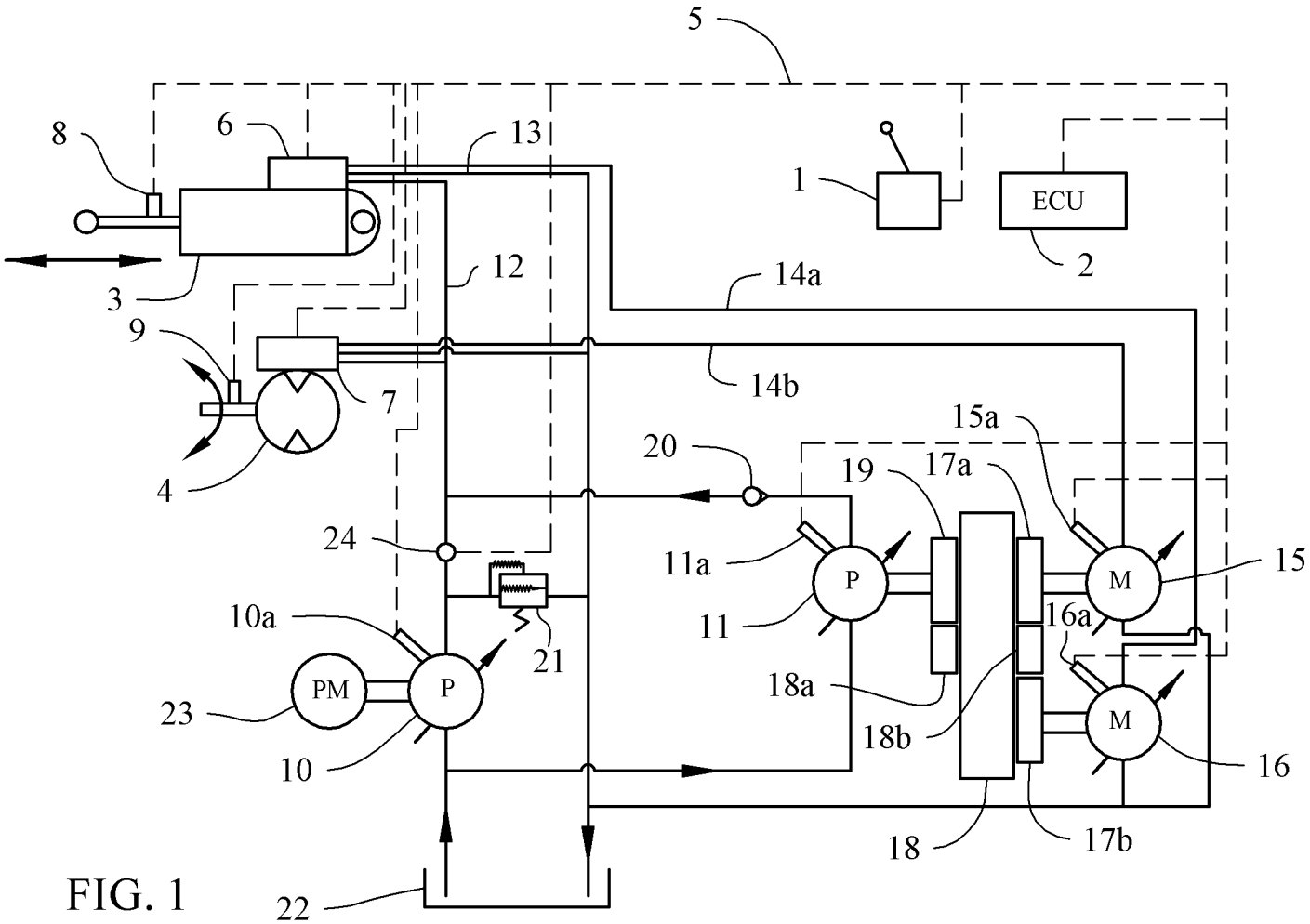
FIG. 1 is an illustration of a hydraulic drive and control system in accordance with an embodiment of the invention.
Figure 2:
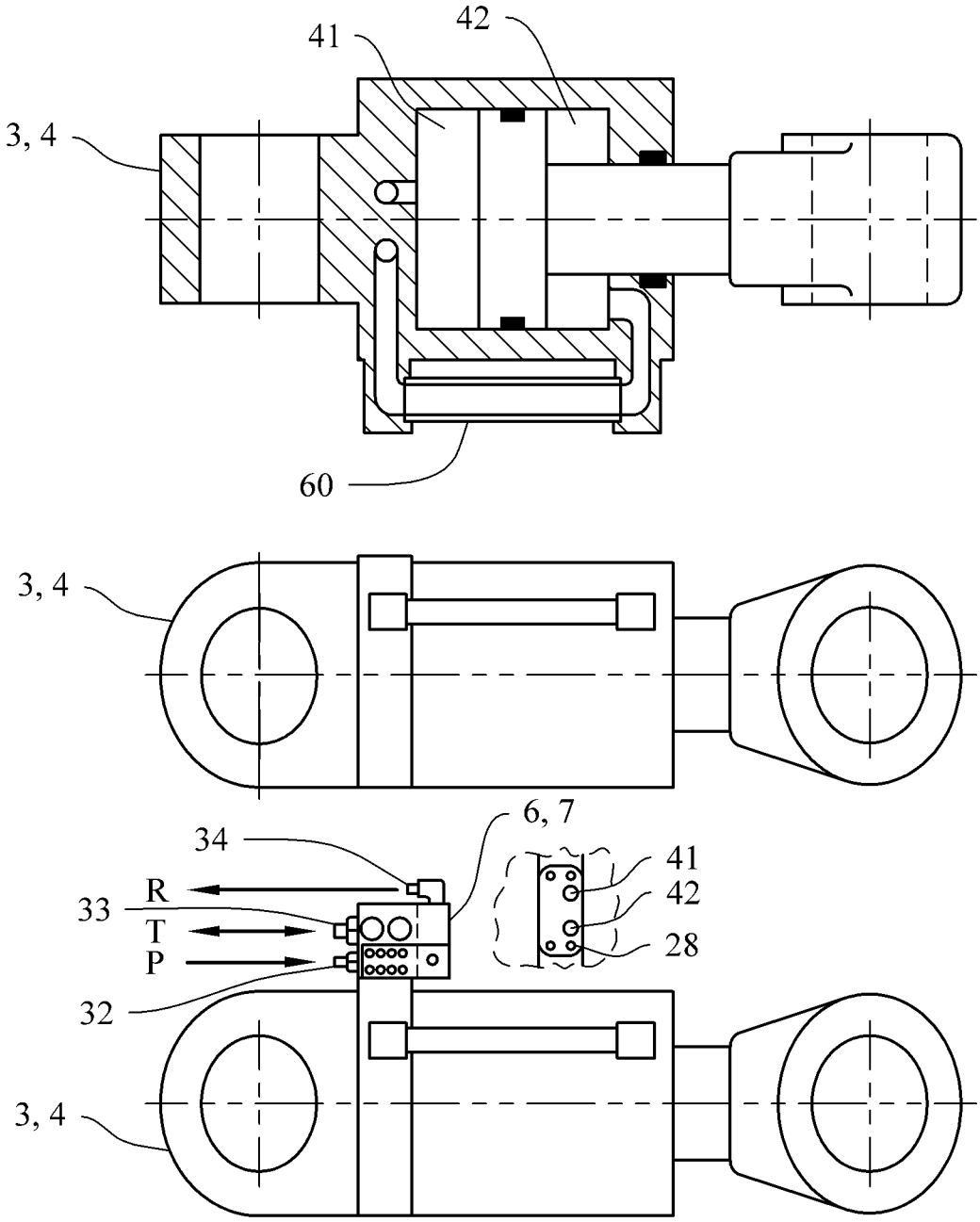
FIG. 2. Is showing how the drive control valve, for safety reasons, is stronger mounted on the actuator then what an flexible conduit normally can be.

FIG. 1 shows a hydraulic drive and control system according to an embodiment of the present invention. The system comprises an operator control unit (1) arranged with at least one shaft, steering wheel on the like to be operated by the operator, feeding in to the electronic control unit ECU (2).

A linear hydraulic cylinder actuator first type (3) with different size on pressurized areas on the piston and a second type hydraulic rotating actuator (4) are shown in the figure. A first position sensor (8) is arranged on the first actuator (3) to measure the position of the piston rod. A second position sensor (9) is arranged on the second actuator (4) to measure the position of the rotating axel of the second actuator. The positions sensor (8) and (9) are coupled electrically to the ECU via an electronic bus system (5), for example a CAN bus. A first valve arrangement (6), here named the drive control valve, is arranged on the first actuator (3) and a second drive control valve arranged on the second actuator (4). The actuators (3) (4) are screwed together with its drive control valves (6) (7) to a very strong unites with nothing between that may leak or brake. The actuators (3) (4) each comprise a first actuating chamber and second actuating camber. For the first the drive control valve (6) is the actuating chambers separated by the piston that has pressured areas of different size. A variable displacement hydraulic pump, here named the main pump, 10 is arranged to pressurize hydraulic fluid from the tank (22) to a supply conduit, here named the common high pressure conduit (12). The hydraulic fluid in the tank (22) is in FIG. 1 essentially unpressurized i.e. essentially at atmospheric pressure. An electrical connector (10*a*) of the main pump (10) is coupled to the ECU via the electronic bus system (5). Displacement signals is measuring the size of displacement of the main pump 10 and also control signals for controlling the displacement of the main pump may be transferred via the connector (10 *a*). A high pressure limiting safety valve (21) (upstream of the main pump (10)) is coupled between the common high pressure pump conduit (12) and the common low pressure return conduit (13). A high pressure sensor (24) is arranged on the common high pressure pump conduit (12) to measure the pressure therein. The drive control valves (6) (7) are hydraulically coupled to both the common high pressure pump conduit (12) and the common low pressure return conduit (13) and to the drive control valve own individual high pressure energy recovering conduit. (14*a*) (14*b*).

In FIG. 1 is presented one of many possibly energy recovering and storing system. The present invention has, as a example, in FIG. 1 *a*. energy recovering and storing system that is good enough for the present inventions total function. The energy recovering and storing system shown comprises a flywheel (18) being coupled via a gear arrangement (18*a*) (19) to a variable displacement pump, here named the assisting energy recovering re-use pump (11). An electrical connector (11*a*) of the assisting energy recovering re-use pump (11) is coupled to the ECU (2) via the bus (5). Displacement signals indicating the displacement of the assisting energy recovering re-use pump (11) and also control signals for controlling the displacement of the assisting energy recovering re-use pump may be transferred via connector (11*a*).

The assisting energy recovering re-use pump (11) is arranged to work in parallel with the main pump (10) to pressurize hydraulic fluid from the tank (22) to the common high pressure pump conduit (12). The assisting energy recovering re-use pump (11) is coupled to the common high pressure pump conduit (12) via a check valve (20). The energy recovering and storing system furthermore comprises a first individual hydraulic rotating energy recovering motor (15) and a second individual hydraulic rotating energy recovering motor (16). The individual hydraulic rotating energy recovering motor (15) (16) are coupled to the flywheel (18) via a gear arrangement (17A) (17B) (18B). The gear arrangement is designed to allow a higher rotation speed of the flywheel than of the assisting energy recovering re-use pump (11) and the individual hydraulic rotating energy recovering motor (15) (16). The gear arrangement (17*a*) (17*b*) (18*b*) may comprise a free wheel function such that the individual hydraulic rotating energy recovering motor (15) (16) may be decoupled from the flywheel (18). Electrical connector (15*a*) (16*a*) of the individual hydraulic rotating energy recovering motor (15) (16) are coupled to the ECU (2) via the bus (5). Displacement signals indicating the displacement of the individual hydraulic rotating energy recovering motor (15) (16) and pressure signals measuring the pressure in the individual hydraulic rotating energy recovering motor and also control signals for controlling the displacement of the individual hydraulic rotating energy recovering motor may be transferred via the connectors (15*a*) (16*a*).

The ECU is arranged to monitor the pressure in the common high pressure pump conduit (12) using a pressure signal from the pressure sensor (24) and to control the displacement in the main pump (10) such pressure in the common high pressure conduit is below the limiting pressure of the high pressure limiting safety valve (21). The high pressure limiting safety valve is consequently only used as a safety valve and not working during normal operation. But controlling the pressure on conduit (12) to be under a limit will stop flow to go to conduit (13) and thereby avoiding energy waste. The ECU (2) is furthermore arranged to receive control signals from the operator control unit 1 indicating desired movements of the hydraulic driven actuators (3) (4) in form of direction and speed. ECU (2) is programmed to avoid movements of the machine that not is possibly to achieve and not suitable for the machine that at the same time is safe, productive and energy efficient. ECU (2) is as a consequence of that changing operator desired movement to allowed movement that is safe and suitable. ECU (2) is at the same time receiving information from position sensors (8) (9) to at least be able to calculate of positions of the moving members, piston rod or axle, of the actuator.

Real direction, speed and acceleration numbers are calculated by the ECU (2) based on said position signals and time. There after, outgoing allowed control signals are going to the, drive control valve (6) or (7) and the drive and control valve is controlling flow different if the actuator is receiving or delivering energy.

If the actuator is receiving energy is there no need for pump flow and the drive control valve is blocking the inlet valve function and letting necessary flow to the actuator to go over the check valve in the drive control valve from common low pressure return conduit and to the low pressure side of the actuator, and at the same time is pressure in the actuators other side having a pressure over a pressure limit and the recovery valve is closing and that flow is forced to go to the individual high pressure energy recovering conduit and to the recovery system. When the operator is controlling the actuator that is receiving energy and when energy is recovered is energy from pumps not used and the operator is only controlling the actuator and the flow that is flowing to the energy recovering and storing system from the drive control valve. The ECU (2) is programmed to control the inlet valve function and the outlet valve function with higher speed values than the signal that is controlling the energy recovering and storing system control value for the actuator. As both inlet and outlet valve function is controlled with speed signals that are higher, will inlet and outlet valves be fully open.

FIG. 2

Here is shown that the actuators (3) and (4) always must have the two pressure sides A and B going to interface between the drive control valve and the actuators. (3) and (4) that are following the drive control valves interface exact with two flow holes for in and outflow and with four treaded holes for four screws.

FIG. 3

Here is shown, the outside on an early drive control valve (6) and (7) using spool type valve function inside and produced with chip machining technique totally and not at all made from casting. The drive control valve is exactly the same for both linear and rotating actuators. Shown is also an optional control pressure accumulator (57) that can be used when needed for safer and faster control or to be able to follow the law. The optional accumulator is (57) only for control pressure flow and a spring is used for storing control pressure energy.

The drive control valve has three hydraulic outside connectors. One (32) letting flow from the common high pressure pump conduit to go to the actuator. One (33) letting flow from the actuator to go to the common low pressure return conduit (13) to tank (22) or to the drive control valves own individual high pressure energy recovering conduit (14A) or (14B) from connector (34). The drive control valve is more like a subsystem. With many valve functions that all together is controlling the drive control valve and the actuators with control signals type increase or decrease going to the electric controlled, control valve (26) and (27) that is in unite with the side covers (29) and (30) and each is controlling flows from or to the actuator. One spool is only controlling flow from the pump to the actuator here short named the P-spool (36) and the other only controlling flow from the actuator is short named the T-spool (37).

There is also a third spool controlling flow to the recovery system named the recovery spool (40). All this spools is also here short named, to pump spool P-spool (36) and for tank spool T-spool (37), and for recovery spool R-spool (40).

Figure 3:
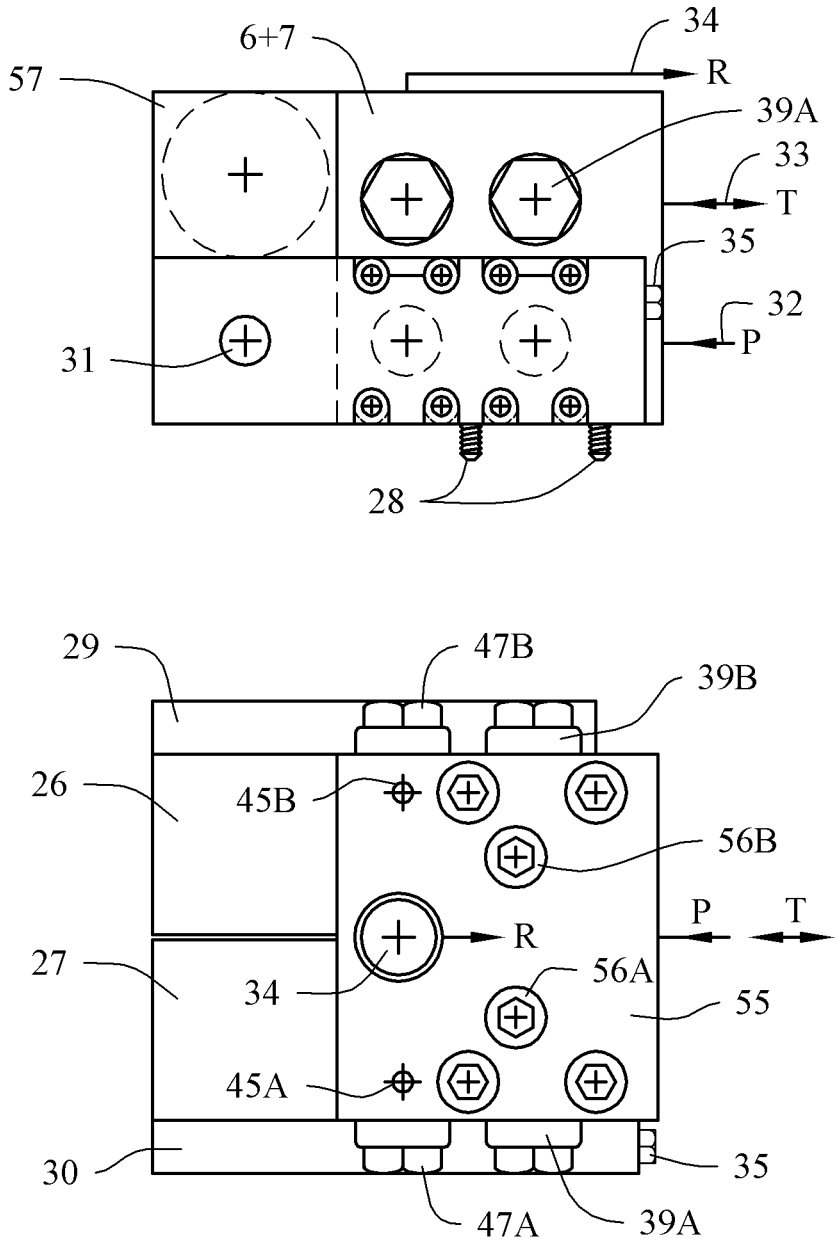
FIG. 3. Is showing the drive control valves small outside size.

The drive control valve has also a number of check-valves and pressure limiting valves (39A) (39B) that is controlling the actuators. A combined pressure reducer and pressure limiting valve (35) is using the pressure in the high pressure pump conduit to be transformed to a low pressure source to be used for controlling the P-spool (36) and the T-spool (37). Plug (56A) and (56B) is going in to two holes that has pressure A and B in the actuators two pressure sides (41) (42). The plug can easily be changed to two pressure sensors sending pressure information via the electronic bus system (5) to the ECU (2) that can take the information and use it for control of efficient pump use, recovery of energy and other important control activities. Under in FIG. 3 where the valve is seen from top is the optional accumulator not shown and instead is shown two electromechanical units (26) (27) controlled from ECU (2) to control two valve function with flow going to or from the actuator.

FIG. 4.

Figure 4:
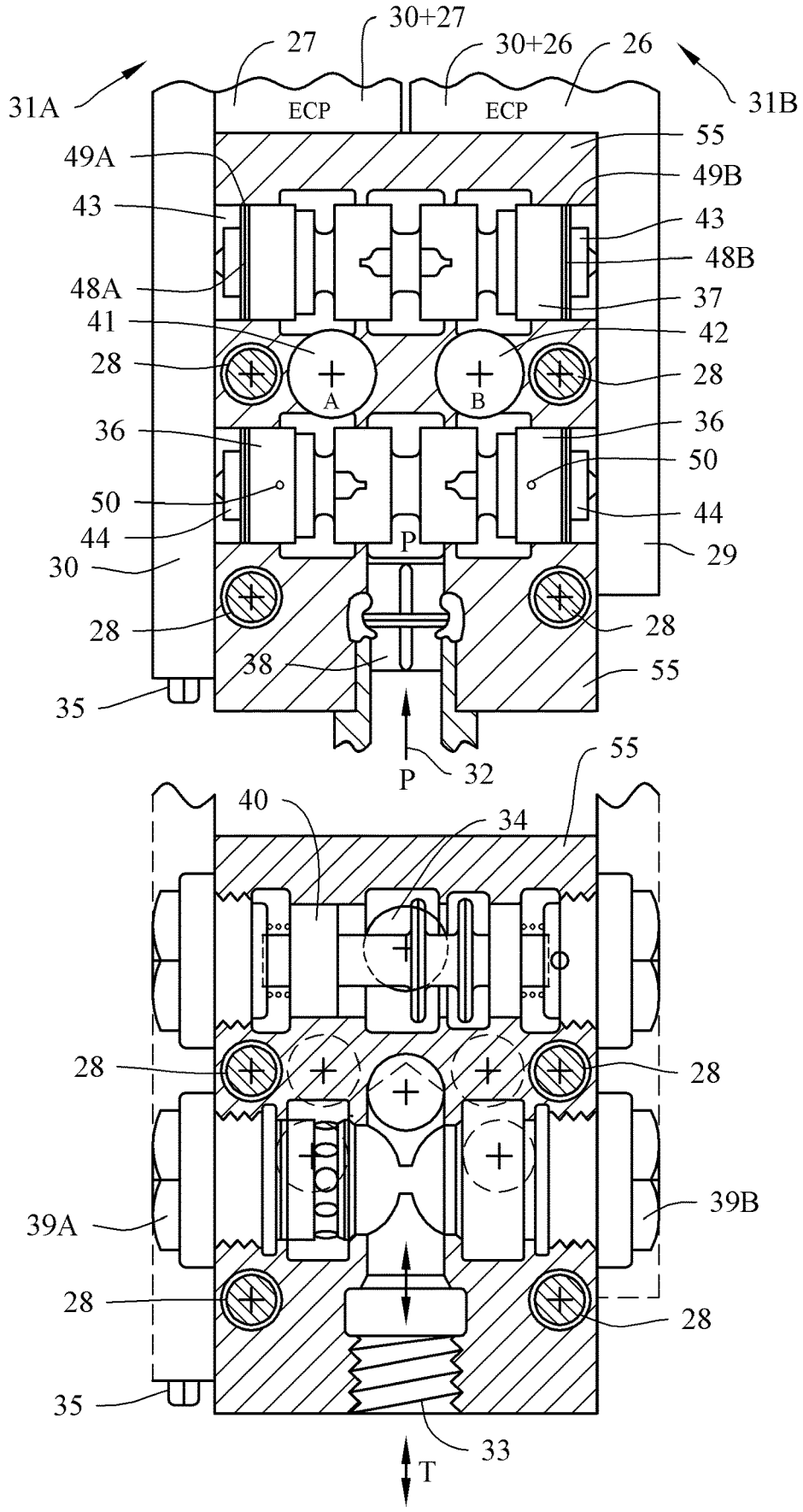
FIG. 4. Is showing: over the drive control valves pump valve and tank valve and under: the recovery valve and the check valves with integrated pressure limiting valve. All is shown when all flows are close to zero.

Here is shown that the drive and control valve (6) and (7) has two levels. High in FIG. 4 is shown the bottom level where the P-spool (36) and the T-spool (37) are placed and between them hole (41) with the pressure from pressure side A and hole (42) with the pressure from pressure side B. In the bottom level and inside the connector from the high pressure pump conduit is a check valve (38), making sure and safe that the flow only can go in one direction, to the P-spool (36). That makes use of the driven machine safer even if and when it is a brake in the common high pressure pump conduit (12). In the bottom level is two side covers (29) and (30) shown. Each of the two side covers has one electromechanical controlled valve (30)+(27), and (30)+(26) for control of the position of the two spools (36) and (37). The two side covers (29) and (30) is different. Side cover (30) with spool control valve (31A) and electromechanical unit (27) has the combined pressure reducing and limiting valve (35) built in, and is controlling the position of the T-spool (37). Side cover (29) with spool control valve (31B) and the electromechanical unit (26) is controlling the position of the P-spool (36). Both side covers has drilled holes going to T-spool (37) and P-spool (36) and also drilled holes for the reduced and limited spool control pressure, and also tank pressure, going in both side covers but also in the drive control valves valve house (55).

Both the P-spool (36) and the T-spool (37) has spool centering device based on a prestresed spring force. Centrering in the P-spool (36) and in the T-spool (37) is different but the spring (53) and the guide ring (54) is the same. The centrering piston (52) in the centrering for the P-spool (36) can be modified with an extra hole to be (51) and used as centrering piston in the T-spool (37).

Figure 5:
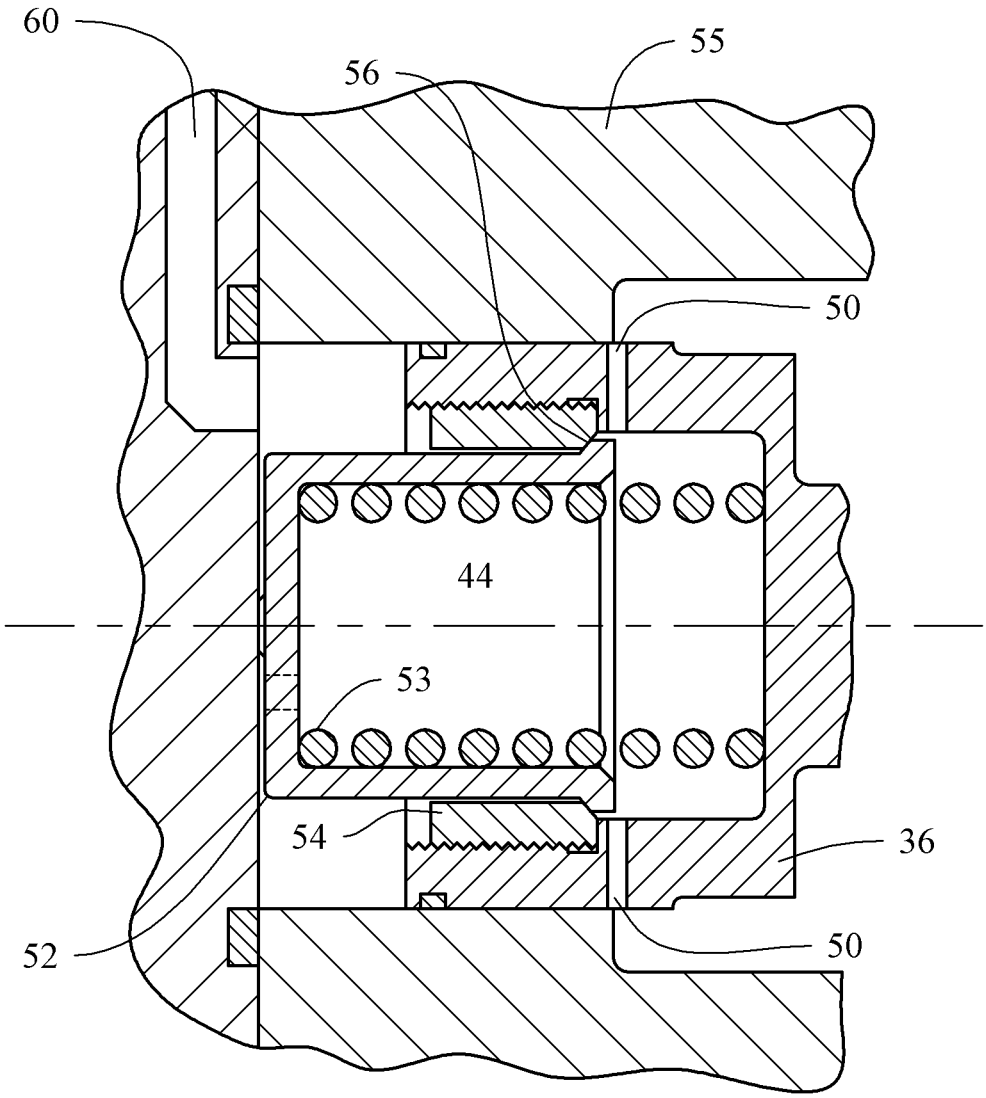
FIG. 5. Is showing how actuator pressure is stopping control pressure to open the pump valve.

The centrering in the P-spool (36) is based on holes (50) in the P-spool that can lock the P-spool (36) from movement in one direction, se FIG. 5.

By controlling the valves to try to give the actuator a higher speed then what ECU (2) are controlling pumps and motors to go to and by that controlling that P-spool (36) and T-spool (37) always is fully open. In this invention is ECU (2) also controlling that those valves is controlling actuator speed under the actuator speed limit simply by letting ECU (2) controlling the individual hydraulic rotating energy recovering motors displacement to be fully open. Recovery of energy under the low speed limit is now not possibly and not necessary and economical to justify. The important and difficult task of controlling at the same time valves, pumps and individual hydraulic rotating energy recovering motors is simply performed by soft ware in the ECU (2) to very low costs.

Figure 6:
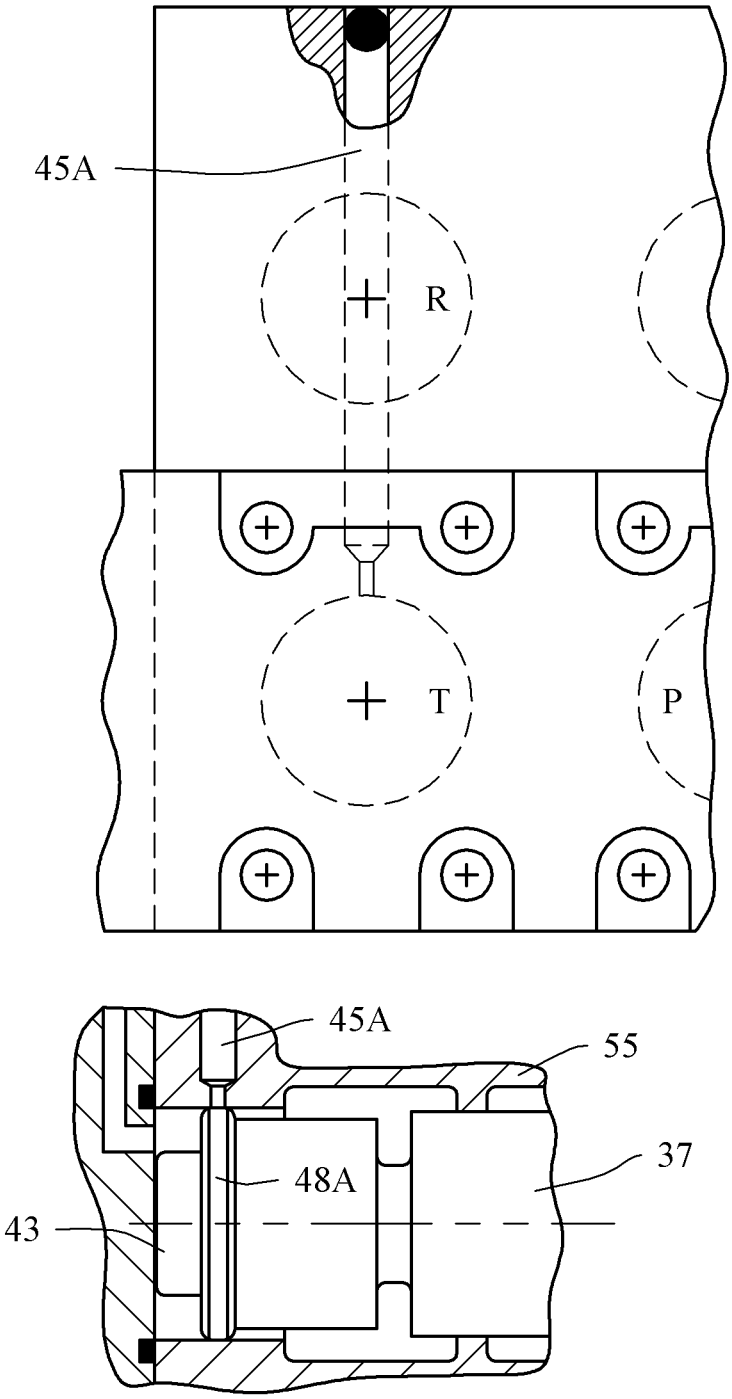
FIG. 6. Is showing how actuator pressure over a pressure limit can close the normally open recovery valve and forced flow from the tank valve to go to the recovery conduit and to recovery of energy.

The T-spool (37) when controlled by the ECU (2) can open a hole so flow of fluid with pressure A or B over a limit is closing the normally open R-spool (40) so that the flow from the actuator can't go to the low pressure return conduit and to tank and instead is the flow forced to go to the actuators own individual high pressure energy recovering conduit to the individual hydraulic rotating energy recovering motor (15) (16) see FIG. 6. The drive control valve (6) (7) in FIG. 4 is shown in its most important and sometimes most difficult situation when it is controlling zero speed and with low or no leakage. As rotating actuators and often even valves has poor or almost bad ability to work without leakage is it necessary to control zero speed, and slow speed, movement and high speed movement different and use valves with low leakage for zero speed, and low speed and rotating pumps and motors for high speeds over the actuator low speed limit. It's not possible to predict the limit as it is depending of the used rotating motors and pumps design, today and in the future.

The drive control valve in FIG. 4 is shown when all flows are close to zero. The maximum stroke for the spools (36) (37) for flow to from the actuator is 6 mm. The recovery valves spool (40) has a stroke about 4 mm and the two check valves 5 mm.

FIG. 5.

The centrering device (44) for the P-spool (36) is shown in a big scale drawing and also how the P-spool (36) can be controlled to be able to not allowing pump flow to go to a low pressure side in the drive control valves holes (41) and (42). The pressure A and B are about the same in the actuator and as in the drive control valve. When the pressure in A or B, here shown, are over a relatively low pressure limit is that pressure going in to the centrering device (44) through hole (50) in the P-spool (36) and is pushing the centrering piston (52) so there will be a contact (56) between piston (52) and guide ring (54). Piston (52) is now not possible to move relatively to the P-spool (36) by the control pressure (60) that tries to move the P-spool (36).

In FIG. 4 is shown that the P-spool (36) now can open for flow from the common high pressure pump conduit (12) to the high pressure side A but not to the low pressure side B as that not is possible because the control pressure on the spool is acting on the hole spool diameter with a lower force than the force that is pushing the centering piston (52) against the guide ring (54). If the piston (52) is moved so that there is no contact with (54) which happens as soon as the spool is moved in the direction of opening a flow way from the pump to A or B, can not a pressure A or B be acting on the centrering piston (52), as a leak way is opened between the piston (52) on the guide ring (54).

That is important and necessary when the drive control valve is controlling an actuator that is driving a load and not is needing the highest pump pressure. The individual hydraulic rotating energy recovering motor (15) (16) is now controlling the speed and not the main pump (10) and there will be a pressure in booth pressure side A and B. When the P-spool (36) first start to move the P-spool (36) can only the first drive pressure be locking one direction of the P-spool (36) as the other centrering device (here in FIG. 5) the pressure side B, has moved so the hole (50) in the P-spool (36) is closed and there is an opening between piston (52)

and guide ring (54). The pressure acting on the spool side and the centering device is now the low pressure side of the controlling pressure for the P-spool (36). There is another possible but more expensive possibility to control that pump flow not can go to a low pressure side of the actuator. ECU (2) can by the bus system get pressure information of pressure inside A and B from pressure sensors measuring pressure instead of plugs in (56A) and (56B). The ECU (2) can relatively easy by software only control the P-spool (36) to not open. If pressure sensors in the future can be more safe working and cheaper can that also be a good and possible alternative but the here preferred simple and not costly way is hard to beat.

FIG. 6 In the FIG. 6 shows, that movement of the T-spool (37) and using the pressure in the flow from the actuators (6) (7) to the drive control valve, can close the normally open R-spool (40), if the fluid in the flow has a pressure over a pressure level. When the T-spool (37) start to move to open up the flow to tank or recovery will the hole (45) going from the R-spools (40) centrering area all the way to the seal (48) on the T-spool (37) to open, so that the pressure in the flow of fluid in the actuator, if it is over the said pressure level, will close the R-spools (40) and the flow with a pressure over the level can only go the actuators and the drive control valves individuality high pressure energy recovering conduit (14*a*) (14*b*) and to the individual hydraulic rotating energy recovering motor (16) (17). The R-spool will be closed both for actuator speed below and over the low speed limit. Under the low speed limit is the pressure in the individual high pressure energy recovering conduit relatively low but higher than if the flow is going direct to the low pressure return conduit, due to the pressure needed to drive the recovery motor at low r.p.m.

The invention claimed is:

1. A method of using an electro-hydraulic drive and control system, the system including a plurality of simultaneously controlled actuators working on a machine, which are supplied with flows of fluid under pressure from a common high pressure pump system, each of the actuators having a flow of fluid through a drive control valve arranged on each of the actuators, the drive control valves being connected in parallel to a common high pressure pump conduit from the common high pressure pump system and to a common low pressure return conduit to a tank and to an individual high pressure energy recovery conduit going from each of the drive control valves to a hydraulic rotating energy recovering motor of each drive control valve, the method comprising the steps of:

a) feeding outer input control signals from an outer operator control unit to an electronic control unit (ECU) for indicating a desired value for the actuators, the desired value including a desired position, speed and acceleration;

b) supplying the ECU with an instantaneous position sensor value from position sensors configured to acquire position, speed and acceleration for each of the actuators, respectively;

c) computing by the ECU an instantaneous speed and acceleration of each of the actuators based on the acquired position, speed and acceleration and on a time value;

d) computing by the ECU an allowed desired value for the machine, the allowed desired value including an allowed direction, position, speed and acceleration for the actuators, the allowed desired value being equal to or less than the desired value of the actuators;

e) computing by the ECU a difference between the allowed desired value and the instantaneous position sensor value to obtain a difference value and an output control signal for each of the actuators to increase or decrease an actuator speed until the instantaneous position sensor value for each of the actuators reaches the allowed desired value;

f) identifying by the ECU one of the actuators requiring a highest pump pressure using information relating to the difference value;

g) controlling the common high pressure pump system to control the speed of the identified actuator of step f) by comparing an allowed desired actuator speed for the identified actuator with the instantaneous speed computed from step c) of the identified actuator, and computing an outgoing control signal to a main pump of the common high pressure pump system, the main pump being configured to decrease or increase a displacement of the main pump;

h) arranging the drive control valves to be independent of the ECU, and capable to block the flow of fluid going from the common high pressure pump system to a low pressure side of the actuators, and for directing a flow of fluid under pressure from the actuators to an energy recovering and storing system;

i) controlling by the ECU:

a T-valve of the drive control valve by increasing an actuator core speed by a first speed value, wherein the actuator core speed being the allowed desired actuator speed;

a P-valve of the drive control valve by increasing the actuator core speed by a second speed value, with the second speed value being greater than the first speed value; and the T-valve and P-valve to be fully open for an actuator speed over a low actuator speed limit, the T-valve and the P-valve being configured to be fully open for a low pressure drop value;

j) controlling a R-Valve of the drive control valve by a pressure in two pressure sides of the actuators, respectively, and wherein the R-valve is closed if flow of pressured fluid is coming from the actuators to the drive control valves;

k) controlling the actuator speed below the low actuator speed limit by controlling the T-valve with a leakage and the individual hydraulic energy recovery motor to a maximum displacement and with no energy recovery;

l) controlling the actuator speed over the low actuator speed limit by controlling the displacement of the main pump and displacement of the individual hydraulic rotating energy recovering motors; and m) controlling the actuator speed when the actuators are not capable of following the allowed desired actuator speed by making one of the actuators to be an actuator requiring the highest pump pressure, and to avoid fluid flow through a high pressure limiting safety valve in the event of displacement of the main pump decreases until pressure in the high pressure pump conduit is below an opening pressure for the high pressure limiting safety valve.

2. The method according to claim 1, wherein the actuator identified in step f) excludes the actuators that are instantaneously recovering energy and the actuators with speeds below the low actuator speed limit, and the actuators associated with information of recovery action fed to the ECU from pressure sensors in the individual common high pressure energy recovering conduit.

3. The method according to claim 1, wherein the ECU, when the displacement of the main pump is close to full displacement, starts a control activity to control and lower the allowed desired actuator speed by a same percent until displacement of the main pump is a percent below a full main pump displacement, and if the percent is increasing, then the speed of the actuators is increased by the same percent until the allowed desired actuator speed is back to not being lowered.

4. The method according to claim 1, wherein the ECU starts a control activity to control a speed of rotation for the main pump to increase until displacement of the main pump is 70% of a maximum main pump displacement.

5. The method according to claim 1, wherein the ECU starts a control activity controlling an assisting energy recovering re-use pump to increase a total flow of fluid of the common high pressure pump system until the main pump displacement decreases to 70% of a maximum main pump displacement.

6. The method according to claim 1, wherein the ECU starts a control activity controlling a position of the actuators with two direction end positions within individual maximums for speed and acceleration of the machine, resulting in that a desired speed is changed to the allowed desired speed.

7. The method according to claim 6, further comprising the step of moving the two direction end positions of the actuators by an operator control unit by way of the control activity of the ECU to create new two direction end positions, while keeping a same speed and acceleration of the actuators for the new two direction end positions.

8. The method according to claim 1, wherein the ECU gets information from the position sensors for surroundings used for automatic control of an allowed position for the machine, and the ECU starts a control activity for controlling the machine to work within the allowed position without hitting objects in the surroundings.

9. The method according to claim 1, wherein when the ECU is utilized for controlling a lowering of a load, and when the flow of fluid from each of the actuator to each of the individual high pressure energy recovering conduit are resulting in a pressure over a high pressure limit, the ECU is configured to control a changing from a speed control operation to increasing a pressure to each of the actuators to a maximum allowed pressure.

10. The method according to claim 1, wherein the P-valve, the T-valve and the R-valve are spool valves.

11. An electro-hydraulic drive and control system, the system comprising:

a plurality of simultaneously controlled actuators working on a machine, the actuators being supplied with flows of pressurized fluid to drive and control the actuators, the actuators each including two pressure sides and a drive control valve that are screwed together, the actuators being selected from the group consisting of a linear motion hydraulic cylinder actuator including different pressure areas and different size input and output fluid flows, and a hydraulic rotating drive actuator including a same size of input and output fluid flows;

a pump apparatus for providing the pressurized fluid comprising:

a continual working main pump and a non-continual working and assisting energy recovery re-use pump, the main pump and the re-use pump each having variable controllable displacement and a sensor each to measure a size of the displacement, the energy recovery re-use pump having a fluid flow that passes through a check valve into a high pressure pump conduit, the high pressure pump conduit going from the pump apparatus in parallel to the drive control valves of the actuators and to a pump inlet;

a common low pressure return conduit going in parallel from an outlet of the drive control valves of the actuators to a tank;

an individual high pressure energy recovery conduit for any one of the actuators capable of recovering energy, the individual high pressure energy recovery conduit going from a second outlet on each of the drive control valves to one individual hydraulic rotating energy recovering motor with controllable variable displacement and a sensor for pressure and displacement;

a high pressure limiting safety valve configured for limiting a maximum pressure in the high pressure pump conduit and, when open, allows the flow of fluid going from the high pressure pump conduit to the low pressure return conduit;

a pressure sensor of the high pressure pump conduit is configured to provide pressure information to an electronic control unit (ECU);

position sensors for each of the actuators are configured to provide position information of the actuators to the ECU;

surroundings position sensors are configured to provide information of a position of the machine to other outside objects to the ECU;

an operator control unit configured for indicating a desired direction and speed for the actuators;

a P-valve associated with each of the drive control valves, the P-valve being configured for controlling fluid flow from the pump apparatus to a pressure side of any one of the actuators; and a T-valve associated with each of the drive control valves, the T-valve being configured for controlling the fluid flow from the pressure sides of any of the actuators into the drive control valve, the P-valve and the T-valve being configured to be fully open when there is a low pressure drop around and below a percent of the high pressure safety valves open up pressure value, the P-valve and the T-valve being controlled by the ECU;

wherein the drive control valves being configured to use information of the pressure in the pressure sides of the actuators, to block the flow of fluid from the pump apparatus to one of the pressure sides in each of the actuators that has a pressure below a pressure limit, and to block the pressurized flow of fluid from each of the actuators to go to the common low pressure return conduit and instead make the flow to go to the individual high pressure energy recovery conduit of the actuators;

wherein a control from the drive control valves or from the ECU is utilized with the pressure in the pressure sides of the actuators, simultaneously to decide when to block flow in the drive control valve;

wherein the ECU is configured to control the P-valve by letting a control pressure act on the P-valve in one direction and letting pressure from one of the pressure sides of the actuators act in another direction, the P-valve being configured to be blocked from opening up as pressure in a high pressure side of the actuators is higher than in a side with the control pressure;

wherein the ECU is configured to control the T-valve;

wherein a return flow to the tank passes a normally open R-valve, and wherein the R-valve is configured to be closed if the pressure in the fluid flow is over a pressure limit, the R-valve being configured to be controlled by the pressure in the pressure sides of any of the actuators and not by the ECU;

wherein the ECU is configured to receive instantaneous information from the position sensors and to compute a position, speed and acceleration of each of the actuators, and wherein the ECU is configured to receive information from a sensor measuring a rotating speed for the main pump and a motor driving the main pump; and wherein the ECU is configured to compute a difference between an allowed desired actuator speed and a computed real actuator speed, based on position information from the position sensors, the ECU is configured to utilizing the position information to send outgoing control signals to increase or decrease a speed of the actuators.

12. The system according to claim 11, wherein the system is configured to be controlled by remote electric control using a bus system or Controller Area Network (CAN) bus system.

13. The system according to claim 11, wherein the P-valve and the T-valve are spool type valves.

14. The system according to claim 11, wherein the fluid flow that is used for electrohydraulic control by the ECU of the P-valve and the T-valve is from the high pressure pump conduit but after passing through a combined pressure reducing and pressure limiting valve, and wherein the control pressure is equal to or less than 25 bar.

15. The system according to claim 11, further comprising a first check valve with integrated actuator high pressure limiting valve is situated between the two pressure sides of each of the actuators in the drive control valve, and a second check valve with integrated actuator high pressure limiting valve is situated in a unit with each of the actuators, and the low pressure return conduit, but inside the drive control valve of the actuators.

* * * * *